US011246387B2

(12) United States Patent
Jung et al.

(10) Patent No.: US 11,246,387 B2
(45) Date of Patent: Feb. 15, 2022

(54) UMBRELLA HAVING BUILT-IN WATERPROOF CASE

(71) Applicant: Gisung Jung, Gimpo-si (KR)

(72) Inventors: Gisung Jung, Gimpo-si (KR); Youngsung Lee, Seoul (KR)

(73) Assignee: Gisung Jung, Gimpo-si (KR)

( * ) Notice: Subject to any disclaimer, the term of this patent is extended or adjusted under 35 U.S.C. 154(b) by 0 days.

(21) Appl. No.: 17/254,934

(22) PCT Filed: Jun. 26, 2019

(86) PCT No.: PCT/KR2019/007705
§ 371 (c)(1),
(2) Date: Dec. 22, 2020

(87) PCT Pub. No.: WO2020/004926
PCT Pub. Date: Jan. 2, 2020

(65) Prior Publication Data

US 2021/0267329 A1 Sep. 2, 2021

(30) Foreign Application Priority Data

Jun. 28, 2018 (KR) ..... 10-2018-0074777

(51) Int. Cl.
*A45B 25/24* (2006.01)
*A45B 19/00* (2006.01)
*A45B 9/02* (2006.01)

(52) U.S. Cl.
CPC ..... *A45B 25/24* (2013.01); *A45B 9/02* (2013.01); *A45B 19/00* (2013.01); *A45B 2019/002* (2013.01); *A45B 2200/1081* (2013.01)

(58) Field of Classification Search
CPC ... A45B 25/24; A45B 2019/002; A45B 19/00; A45B 9/02; A45B 2200/1081
See application file for complete search history.

(56) References Cited

U.S. PATENT DOCUMENTS 892,813 A * 7/1908 Dolles ..... A45B 25/24 135/25.31
1,455,410 A * 5/1923 Otto ..... A45B 25/24 135/25.41
1,592,723 A * 7/1926 Chism ..... A45B 25/24 135/26
2,091,676 A * 8/1937 Fliegner ..... A45B 19/04 135/25.31

(Continued)

FOREIGN PATENT DOCUMENTS

JP 2000070024 A * 3/2000 ..... A45B 25/24
WO WO-2012142935 A1 * 10/2012 ..... A45B 19/04

*Primary Examiner* — Noah Chandler Hawk
(74) *Attorney, Agent, or Firm* — Korus Patent, LLC; Seong Ii Jeong

(57) ABSTRACT

The present invention relates generally to an umbrella having a built-in waterproof case, in which a folded umbrella main body is accommodated in an umbrella handle, and more particularly to an umbrella having a built-in waterproof case, which, in order to carry or store a wet folding umbrella used, allows an umbrella handle and an umbrella top to be transformed into an umbrella storage case without using a separate plastic bag and then allows the umbrella to be easily opened or re-stored while allowing a folded umbrella body to be accommodated in the umbrella handle.

3 Claims, 4 Drawing Sheets

(56) References Cited

U.S. PATENT DOCUMENTS

| | | | | |
|---|---|---|---|---|
| 4,456,023 | A * | 6/1984 | Fujihashi | A45B 19/00<br>135/25.41 |
| 8,893,736 | B2 * | 11/2014 | Kazim | A45B 19/04<br>135/20.3 |
| 2003/0094189 | A1 * | 5/2003 | Ko | A45B 9/02<br>135/16 |

* cited by examiner

UMBRELLA HAVING BUILT-IN WATERPROOF CASE

TECHNICAL FIELD

The present invention relates generally to an umbrella having a built-in waterproof case, and more particularly to an umbrella having a built-in waterproof case, which is developed to transform an umbrella handle and an umbrella top into an umbrella storage case without using a separate plastic bag and then accommodate a folded umbrella body in order to carry or store a wet folding umbrella used.

BACKGROUND ART

Umbrellas used in rainy weather can be classified into foldable umbrellas designed to be folded two to four times for easy portability and long umbrellas, and can be classified into umbrellas having an automatic unfolding function and umbrellas designed to be unfolded manually.

Among the above umbrellas, a folding umbrella is generally configured such that an umbrella cloth is wound in one direction in a folded state and is fixed by winding a fixing band that is fastened to the umbrella cloth.

However, in the case of a wet umbrella that has just been used, when it is carried in this state, a person carrying it becomes wet with water. Accordingly, it may be put into a separate plastic bag. Alternatively, when a storage bag acquired upon purchase and made of an umbrella cloth in which the umbrella is accommodated is used, the storage bag is tied to the ring of the umbrella handle, carried, and then untied from the ring to store the umbrella. However, there is still a lot of concern that water leaks out when it is stored in a bag.

In particular, when the storage bag is used, disadvantages arise in that there is a lot of risk of loss of the storage bag and the process of tying or releasing it to or from the ring of the umbrella handle is cumbersome.

Accordingly, in various conventional technologies, structures capable of storing an umbrella in an umbrella handle can be found. However, most of them are not actually used because the process of storing and withdrawing umbrellas is complicated.

DISCLOSURE

Technical Problem

The present invention has been developed to overcome the above-described problems, and an object of the present invention is to develop an umbrella having a built-in waterproof case, in which an umbrella handle and an umbrella top are transformed into an umbrella storage case without requiring the work of additionally separating and assembling an umbrella shaft and the umbrella may be easily opened or re-stored while allowing a folded umbrella body to be accommodated in the umbrella handle.

Technical Solution

In order to accomplish the above object, the present invention provides an umbrella having a built-in waterproof case, in which a space is formed inside the umbrella handle of an umbrella so that the umbrella including an umbrella shaft can be inserted therein, the umbrella including:

a fixed handle part having a regular polygonal column shape as a whole, and including a locking part configured to extend in a stepped form at the lower end thereof and to have a circular cross section, an umbrella shaft insertion depression formed in the center of the top surface thereof and configured such that the lower end of the umbrella shaft of the folding umbrella is inserted and fixed thereto, a rotation guide groove depressed in a circular ring shape around the umbrella shaft insertion depression, and a first ball seating groove formed by being depressed in a semicircular shape along the middle of the inner circumferential surface of the rotation guide groove;

a rotating handle part having the same regular polygonal column shape as the fixed handle part, and including a rotation guide protrusion inserted into the rotation guide groove below it, a second ball seating groove depressed in a semicircular shape at a position corresponding to the first ball seating groove of the rotation guide protrusion, a plurality of bearing balls inserted into a space formed by the first and second ball seating grooves, and an O-ring mounted in a groove formed along the top of the outer circumferential surface;

a sliding handle part configured such that the center thereof is hollow in a regular polygonal shape corresponding to that of the fixed handle part and the rotating handle part and four guide grooves extending spirally in one rotation direction downward from the top and four semicircular seating grooves formed at the ends of the guide grooves are radially formed at regular intervals along the inner circumference thereof; and an umbrella top mounted in the center of the top end of the umbrella, configured such that four hemispherical protrusions formed along the edge of the lower end and configured to be seated in the semi-circular seating grooves through the guide grooves and a waterproof ring mounted below the hemispherical protrusions are formed, and adapted to be selectively attached to and detached from the sliding handle part.

Furthermore, at least one through drain hole is formed in the umbrella top.

Moreover, the top surface of the umbrella top is depressed in a circular shape, the drain hole is formed in the bottom surface of the umbrella top, a mounting depression the inner diameter of which is reduced stepwise is formed on the depressed umbrella top, and threads are formed along the outer circumference of the umbrella top;

a rotating disk formed in a disk shape, configured to be inserted into the mounting depression and be rotated and to have a through hole corresponding to the drain hole, and provided with a handle protruding from the center thereof is additionally mounted; and a finishing ring configured such that threads corresponding to the threads of the umbrella top are formed on the inner circumference thereof and one side of the inner circumference is reduced stepwise to prevent the separation of the rotating disk is additionally mounted.

Advantageous Effects

As described above, the present invention is configured to allow the sliding handle part to be moved such that the umbrella is accommodated therein or withdrawn therefrom, and to, when the fixed handle part is rotated, allow the rotating handle part to be relatively rotated and the umbrella to be neatly wound and arranged such that the umbrella is squeezed dry and water is drained if necessary, thereby providing the effect of making it easy to store and carry the umbrella.

Furthermore, in the umbrella having a built-in waterproof case according to the present invention, the umbrella handle is divided into three portions, i.e., top, middle and bottom portions, so that the length of the handle may be adjusted and may be rotated by 360 degrees, and, when the bottom portion of the handle is rotated, an umbrella cloth is wound into a cylinder inside the polygon (octagonal cylinder) of the middle and top portions, and thus water droplets condensed on the umbrella cloth may be conveniently removed.

MODE FOR INVENTION

Accordingly, the configuration of the present invention will be described in detail so that those skilled in the art can easily understand and reproduce it by the accompanying drawings.

Figure 1:
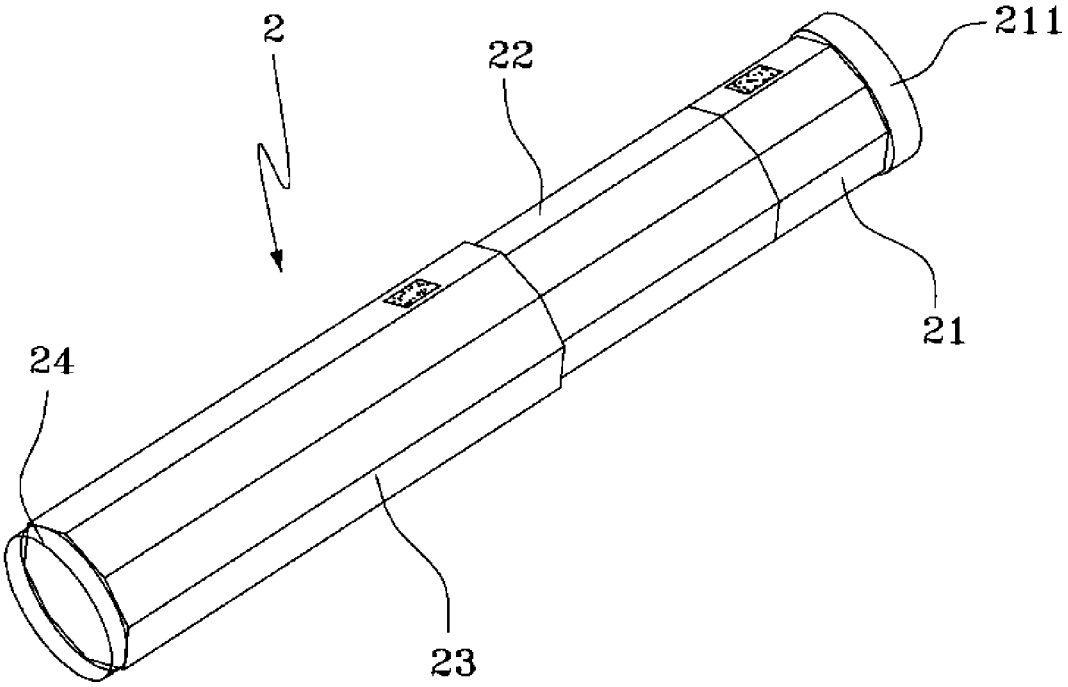
FIG. 1 is a perspective view according to an embodiment of the present invention.
Figure 2:
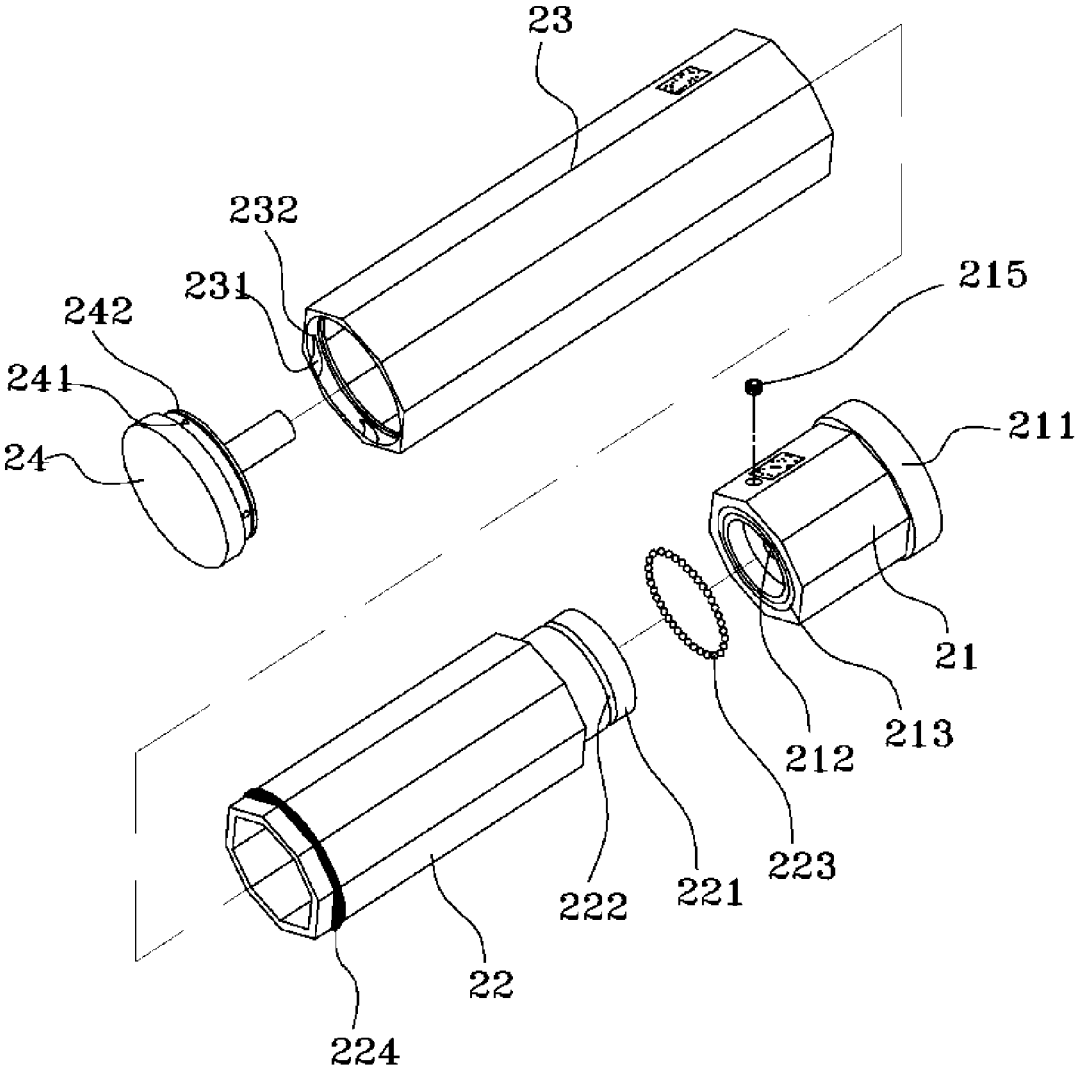
FIG. 2 is an exploded perspective view according to an embodiment of the present invention.
Figure 3:
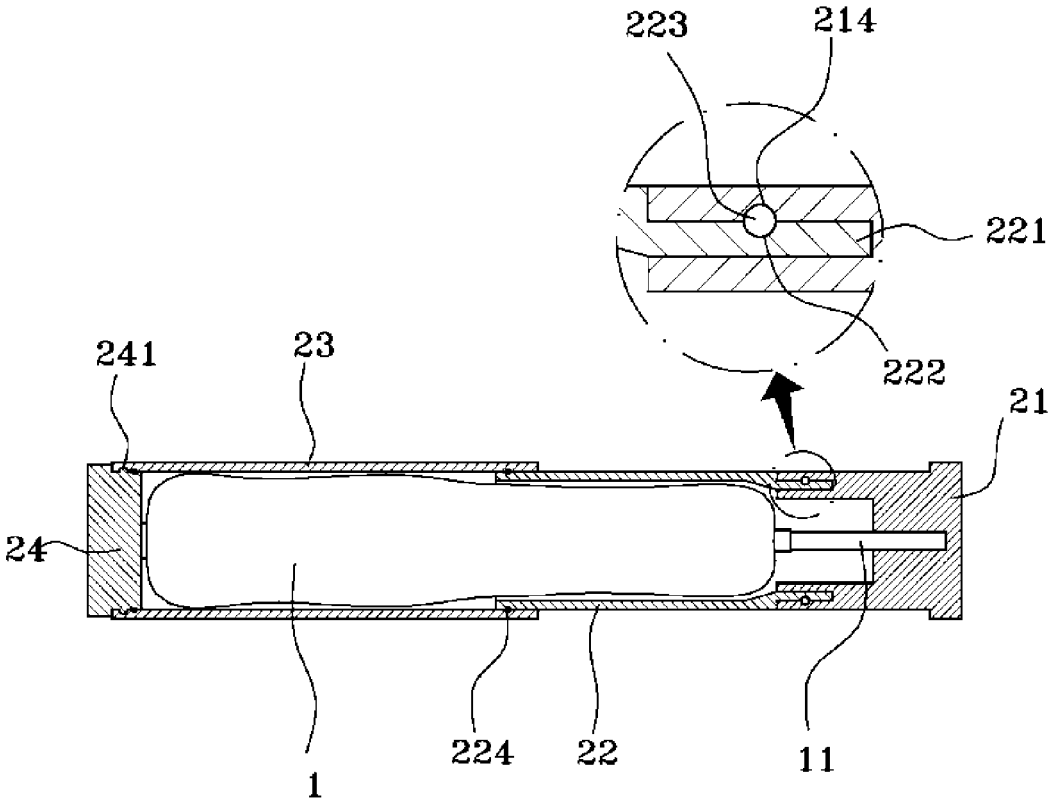
FIG. 3 is a sectional view according to an embodiment of the present invention.
Figure 4:
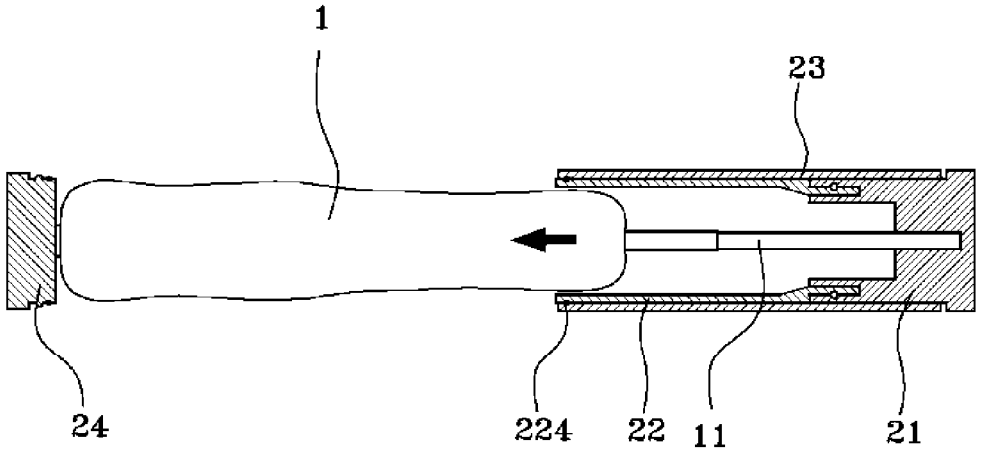
FIG. 4 is a sectional view showing a state in which an umbrella according to an embodiment of the present invention is withdrawn.

FIG. 1 is a perspective view according to an embodiment of the present invention, FIG. 2 is an exploded perspective view according to an embodiment of the present invention, FIG. 3 is a sectional view according to an embodiment of the present invention, and FIG. 4 is a sectional view showing a state in which an umbrella according to an embodiment of the present invention is withdrawn. There is shown an umbrella having a built-in waterproof case, in which a space is formed inside the umbrella handle 2 of an umbrella 1 so that the umbrella 1 including an umbrella shaft 11 can be inserted therein; the umbrella including:

a fixed handle part 21 having a regular polygonal column shape as a whole, and including a locking part 211 configured to extend in a stepped form at the lower end thereof and to have a circular cross section, an umbrella shaft insertion depression 212 formed in the center of the top surface thereof and configured such that the lower end of the umbrella shaft 11 of the folding umbrella 1 is inserted and fixed thereto, a rotation guide groove 213 depressed in a circular ring shape around the umbrella shaft insertion depression 212, and a first ball seating groove 214 formed by being depressed in a semicircular shape along the middle of the inner circumferential surface of the rotation guide groove 213;

a rotating handle part 22 having the same regular polygonal column shape as the fixed handle part 21, and including a rotation guide protrusion 221 inserted into the rotation guide groove 213 below it, a second ball seating groove 222 depressed in a semicircular shape at a position corresponding to the first ball seating groove 214 of the rotation guide protrusion 221, a plurality of bearing balls 223 inserted into a space formed by the first and second ball seating grooves 214 and 222, and an O-ring 224 mounted in a groove formed along the top of the outer circumferential surface;

a sliding handle part 23 configured such that the center thereof is hollow in a regular polygonal shape corresponding to that of the fixed handle part 21 and the rotating handle part 22 and four guide grooves 231 extending spirally in one rotation direction downward from the top and four semicircular seating grooves 232 formed at the ends of the guide grooves 231 are radially formed at regular intervals along the inner circumference thereof; and an umbrella top 24 mounted in the center of the top end of the umbrella 1, configured such that four hemispherical protrusions 241 formed along the edge of the lower end and configured to be seated in the semi-circular seating grooves 232 through the guide grooves 231 and a waterproof ring 242 mounted below the hemispherical protrusions 241 are formed, and adapted to be selectively attached to and detached from the sliding handle part 23.

In the present application, based on the principle that an inner space is expanded and contracted by the movement of the sliding handle part 23, when the inner space is expanded, the umbrella 1 is stored in a folded state, and it is completely stored when the umbrella top 24 is mounted finally. When the inner space is contracted, the umbrella 1 is exposed to the outside and may be opened. In the exploded perspective view, the shape of the umbrella 1 was omitted.

Furthermore, the umbrella shaft 11 has a telescopic structure in which a small-diameter part is inserted into a large-diameter part. A common umbrella that is folded two to four times is used as the umbrella 1. In the case of an automatic umbrella, it is sufficient to have a structure that is automatically unfolded by forming a button on the fixed handle part 21. FIGS. 1 and 2 show an example of an automatic umbrella, and FIGS. 3 and 4 show an example of a manual umbrella.

Furthermore, it is preferable to insert the rotating guide protrusion 221 of the rotating handle part 22 into the rotating guide groove 213 of the fixed handle part 21 of the present application, to fill the bearing balls 223 in the fixed handle part 21 through a screw hole communicating with the first and second ball seating holes 214 and 222, and to finish a related configuration with a headless bolt 215.

In the use of the umbrella 1 according to the present application, based on a right-handed user, the hemispherical protrusion 241 is separated from the semi-circular seating groove 232 by rotating the sliding handle part 23 with the left hand while holding the fixed handle part 21 with the right hand and is then pulled. Accordingly, the umbrella top 24 is separated, and the sliding handle part 23 is moved to the lowermost portion.

In the case of a manual umbrella, when the exposed umbrella is pulled, the length of the umbrella shaft 11 is increased, and then the umbrella may be unfolded. In the case of an automatic umbrella, it is opened by pressing a button. In the case of the button, when the button of the sliding handle part 23 is pressed as in the structure shown in FIGS. 1 and 2, the button of the fixed handle part 21 is pressed and operated.

Conversely, in the case where the umbrella is folded, when small portions of the ends of umbrella ribs are inserted into the sliding handle part 23 in the position in which the umbrella has been completely lowered downward after being folded and then a user pulls the fixed handle part 21 while holding the fixed handle part 21 with the right hand and holding the sliding handle part 23 with the left hand and turning the sliding handle part 23 in one direction, the umbrella is gradually inserted, and stained water drops fall due to the pressure. Finally, when the umbrella top 24 is coupled to the sliding handle part 23, the operation is completed. In this folded state, there is no concern that water leaks out, so that the umbrella may be easily stored in a bag.

Figure 5:
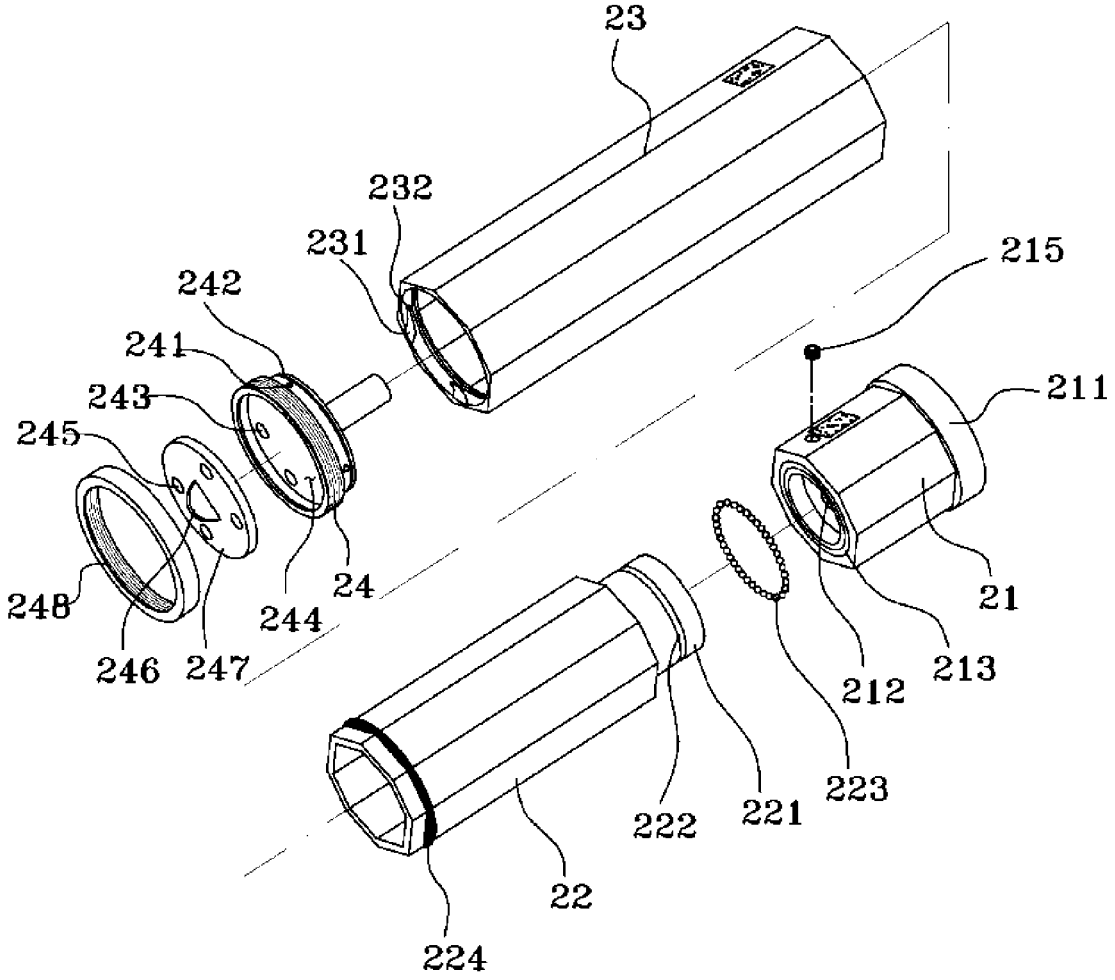
FIG. 5 is an exploded perspective view according to another embodiment of the present invention.

FIG. 5 is an exploded perspective view according to another embodiment of the present invention, which shows an embodiment in which at least one through drain hole 243 is formed in the umbrella top 24.

In the above embodiment, water may be discharged through the drain hole 243 in a place where water can be discharged. If necessary, it may be possible to develop structures in which the drain hole 243 is selectively opened and closed in various manners.

Accordingly, the present application proposes an embodiment in which:

the top surface of the umbrella top 24 is depressed in a circular shape, the drain hole 243 is formed in the bottom surface of the umbrella top 24, a mounting depression 244 the inner diameter of which is reduced stepwise is formed on the depressed umbrella top 24, and threads are formed along the outer circumference of the umbrella top 24;

a rotating disk 247 formed in a disk shape, configured to be inserted into the mounting depression 244 and be rotated and to have a through hole 245 corresponding to the drain hole 243, and provided with a handle 246 protruding from the center thereof is additionally mounted; and a finishing ring 248 configured such that threads corresponding to the threads of the umbrella top 24 are formed on the inner circumference thereof and one side of the inner circumference is reduced stepwise to prevent the separation of the rotating disk 247 is additionally mounted.

In the above embodiment, when the through hole 245 and the drain hole 243 are aligned with each other by rotating the rotating disk 247 while holding the handle 246, a state is entered in which water can be drained. To prevent drainage, the rotating disk 247 is rotated such that the through hole 245 and the drain hole 243 are not aligned with each other.

In this case, a configuration for the waterproofness of the rotating disk 247 and the umbrella top 24 may be added, and a structure for preventing rotation unless force exceeds a certain level may be devised in various manners.

The invention claimed is:

1. An umbrella having a built-in waterproof case, in which a space is formed inside an umbrella handle (2) of an umbrella (1) so that the umbrella (1) including an umbrella shaft (11) can be inserted therein, the umbrella comprising:

a fixed handle part (21) having a regular polygonal column shape as a whole, and including a locking part (211) configured to extend in a stepped form at a lower end thereof and to have a circular cross section, an umbrella shaft insertion depression (212) formed in a center of a top surface thereof and configured such that a lower end of the umbrella shaft (11) of the folding umbrella (1) is inserted and fixed thereto, a rotation guide groove (213) depressed in a circular ring shape around the umbrella shaft insertion depression (212), and a first ball seating groove (214) formed by being depressed in a semicircular shape along a middle of an inner circumferential surface of the rotation guide groove (213);

a rotating handle part (22) having a same regular polygonal column shape as the fixed handle part (21), and including a rotation guide protrusion (221) inserted into the rotation guide groove (213) below it, a second ball seating groove (222) depressed in a semicircular shape at a position corresponding to the first ball seating groove (214) of the rotation guide protrusion (221), a plurality of bearing balls (223) inserted into a space formed by the first and second ball seating grooves (214 and 222), and an O-ring (224) mounted in a groove formed along a top of an outer circumferential surface;

a sliding handle part (23) configured such that a center thereof is hollow in a regular polygonal shape corresponding to that of the fixed handle part (21) and the rotating handle part (22) and four guide grooves (231) extending spirally in one rotation direction downward from a top and four semicircular seating grooves (232) formed at ends of the guide grooves (231) are radially formed at regular intervals along an inner circumference thereof; and an umbrella top (24) mounted in a center of a top end of the umbrella (1), configured such that four hemispherical protrusions (241) formed along an edge of a lower end and configured to be seated in the semi-circular seating grooves (232) through the guide grooves (231) and a waterproof ring (242) mounted below the hemispherical protrusions (241) are formed, and adapted to be selectively attached to and detached from the sliding handle part (23).

2. The umbrella of claim 1, wherein at least one through drain hole (243) is formed in the umbrella top (24).

3. The umbrella of claim 2, wherein:

a top surface of the umbrella top (24) is depressed in a circular shape, the drain hole (243) is formed in a bottom surface of the umbrella top (24), a mounting depression (244) an inner diameter of which is reduced stepwise is formed on the depressed umbrella top (24), and threads are formed along an outer circumference of the umbrella top (24);

a rotating disk (247) formed in a disk shape, configured to be inserted into the mounting depression (244) and be rotated and to have a through hole (245) corresponding to the drain hole (243), and provided with a handle (246) protruding from a center thereof is additionally mounted; and a finishing ring (248) configured such that threads corresponding to the threads of the umbrella top (24) are formed on an inner circumference thereof and one side of the inner circumference is reduced stepwise to prevent separation of the rotating disk (247) is additionally mounted.

* * * * *